US008172073B2

(12) United States Patent
Luger et al.

(10) Patent No.: US 8,172,073 B2
(45) Date of Patent: May 8, 2012

(54) DEVICE FOR DETECTING FAULTY POSITIONING OF A CARRYING CABLE IN A CABLEWAY SYSTEM

(75) Inventors: Peter Luger, Dornbirn (AT); Josef Gisler, Steffisburg (CH)

(73) Assignee: Innova Patent GmbH, Wolfurt (AT)

( * ) Notice: Subject to any disclaimer, the term of this patent is extended or adjusted under 35 U.S.C. 154(b) by 386 days.

(21) Appl. No.: 12/472,416

(22) Filed: May 27, 2009

(65) Prior Publication Data

US 2009/0294254 A1 Dec. 3, 2009

(30) Foreign Application Priority Data

May 27, 2008 (AT) ..... A 847/2008

(51) Int. Cl.
*B65G 43/00* (2006.01)

(52) U.S. Cl. ..... 198/571; 198/810.03; 104/179

(58) Field of Classification Search ..... 198/321–338, 198/838, 806, 810.03; 104/115, 173.1–240
See application file for complete search history.

(56) References Cited

U.S. PATENT DOCUMENTS

| | | | | |
|---|---|---|---|---|
| 3,140,670 | A * | 7/1964 | Renninger | 104/178 |
| 3,471,660 | A * | 10/1969 | Peters | 200/61.13 |
| 3,858,520 | A * | 1/1975 | Patin | 104/89 |
| 4,363,945 | A * | 12/1982 | Kunczynski | 200/61.18 |
| 4,671,187 | A | 6/1987 | Kunczynski | |
| 6,356,202 | B1 * | 3/2002 | Albrich et al. | 340/686.2 |
| 6,863,174 | B1 | 3/2005 | Trieb | |
| 7,472,009 | B2 * | 12/2008 | Baldwin | 701/50 |
| 2008/0208519 | A1 | 8/2008 | Thum | |

FOREIGN PATENT DOCUMENTS

| | | | |
|---|---|---|---|
| AT | 226772 | B | 4/1963 |
| AT | 388146 | B | 5/1989 |
| AT | 390926 | B | 7/1990 |
| AT | 405387 | B | 7/1999 |
| DE | 19620065 | A1 | 11/1997 |
| DE | 102007006316 | B3 | 4/2008 |
| EP | 1 538 112 | A1 | 6/2005 |

OTHER PUBLICATIONS

Austrian Office Action dated Mar. 31, 2009.
European Search Report dated Aug. 25, 2009.

* cited by examiner

*Primary Examiner* — Gene Crawford
*Assistant Examiner* — William R Harp
(74) *Attorney, Agent, or Firm* — Laurence A. Greenberg; Werner H. Stemer; Ralph E. Locher

(57) ABSTRACT

An assembly on a cableway or a goods-conveying system for detecting incorrect positioning of a carrying cable on a mount with a channel in which the carrying cable is located. The assembly includes a device for detecting the faulty positioning of the carrying cable. A segment of the mount is movable, and the device for detecting the incorrect positioning of the carrying cable detects movement of the portion of the mount. It is thus possible for incorrect positioning of the carrying cable, which results in this segment being displaced, to be detected in good time, even before the carrying cable in this portion has been completely derailed.

14 Claims, 3 Drawing Sheets

DEVICE FOR DETECTING FAULTY POSITIONING OF A CARRYING CABLE IN A CABLEWAY SYSTEM

CROSS-REFERENCE TO RELATED APPLICATION

This application claims the priority, under 35 U.S.C. §119, of Austrian application A 847/2008, filed May 27, 2008; the prior application is herewith incorporated by reference in its entirety.

BACKGROUND OF THE INVENTION

Field of the Invention

The invention lies in the field of person and/or goods-conveying cableway systems. Specifically, the invention pertains to a system and a device in a cableway or a goods-conveying system for detecting the incorrect positioning of a carrying cable on a mount with a channel in which the carrying cable is located.

Carrying cables of cableways for conveying persons, and also those for conveying materials or of goods-conveying systems, such as endless conveyors (cf. U.S. Pat. No. 6,863,174 B1 and European published patent application EP 1 538 112 A), in which the present invention can be used are guided in the prior art, for example, on supports via saddles and/or carrying-cable shoes, on which they are located in a mount with a channel which is open in the upward direction. Transporting means such as cars or conveying belts move along the carrying cable or cables. In the channel, the carrying cable, depending on the length of the saddle, is secured against derailments by one or more clamps. In the region upstream and downstream of these clamps, in which the carrying cable, in the non-loaded state, in some cases is not located at all and, in a stage in which it is loaded by a transporting means, e.g. a car, is only located loosely in the channel, the carrying cable may undergo derailment, for example by being deflected laterally by the wind, in which case it is lifted out of the channel and ends up located alongside the mount. In order to prevent the carrying cable from parting company with the saddle altogether, so-called carrying-cable interceptors are fitted alongside the mount, and these may also be equipped with, or connected to, a detector in order for a derailed carrying cable to be detected and for the system to be switched off.

As long as the carrying cable is not subjected to any loading, however, a carrying cable which has already been derailed is often still not in contact with the carrying-cable interceptor or the detector, in which case incorrect positioning of the carrying cable is detected only when the carrying cable, under the weight of the already relatively close transporting means, is forced downward to the extent where it rests on a carrying-cable interceptor and the detector indicates the incorrect positioning of the carrying cable.

In this situation, however, it is often already difficult for the transporting means to be conveyed back into a station of the cableway system in order to allow the passengers to alight safely and to reposition the carrying cable correctly on the saddle. Moreover, the carrying cable or the saddle may already have been damaged. Accidents are also possible in this situation.

SUMMARY OF THE INVENTION

It is accordingly an object of the invention to provide a system and a device for detecting the faulty positioning of a carrying cable in a cableway system which overcomes the above-mentioned disadvantages of the heretofore-known devices and methods of this general type and which provides for an assembly for a cable shoe which allows incorrect positioning of the carrying cable to be detected in good time.

With the foregoing and other objects in view there is provided, in accordance with the invention, an assembly for detecting a faulty positioning of a carrying cable in a cableway or goods-conveying system. The assembly comprises:

a mount formed with a channel in which the carrying cable is located;

the mount having a movably mounted segment forming a portion of said mount; and a device disposed to detect a movement of the movably mounted segment of the mount for detecting a faulty positioning of the carrying cable.

The terms cableway system and cableway as used herein include corresponding person-conveying and goods-conveying systems with carrying cables.

According to the invention, a segment, or portion, of the mount in the channel of which the carrying cable is movably mounted. The incorrect positioning of the carrying cable, which results in this segment being displaced, can be detected in good time, even before the carrying cable in this portion has been completely derailed.

Detection of the movement and/or change in position of the movably mounted segment of the mount can take place in various ways. Use can be made, for example, of all the devices known for measuring purposes and in electrical engineering for detecting a change in position, pressure or force. An example of a simple option would be that of the portion being coupled electromagnetically or optically to the device for detecting incorrect positioning of the carrying cable.

However, it is preferred, within the context of the invention, for the device for detecting the incorrect positioning of the carrying cable to be connected mechanically to the movable portion of the mount, since this is a solution which has been tried and tested and is very robust and functions even under adverse weather conditions.

In a development of the invention, it may be provided here that the device for detecting incorrect positioning of the carrying cable has an interrupting rod which, when the change in position of the movable portion of the mount exceeds a predetermined value, is broken off from a lever which is connected to the movable portion of the mount. It is also possible, however, for the interrupting rod to be broken off from the movable portion itself.

In order to provide for the movement capability of the movable portion of the mount, the movable portion of the mount can be pivoted about an axis of rotation. It is also possible for the movable portion of the mount to be displaceable along a sliding surface. If, in a particularly preferred embodiment of the invention, the sliding surface is formed by a circular-cylinder portion, the movable portion of the mount, ultimately, is pivoted about an axis which coincides with the center point of the curvature of the sliding surface. It is also conceivable, however, to have other forms of curved sliding surfaces which do not define a single pivot axis for the movable portion of the mount.

According to the invention, the movable portion of the mount is preferably located in a region of the mount which is spaced apart both from one end of the mount and from a clamp and, in particular, in a region between one end of the mount and a clamp for the carrying cable. The reason for this is that, in most cases, the carrying cable, in the non-loaded state, does not reach the end of the mount in the channel, in which case it would not be possible to detect incorrect positioning of the carrying cable either. However, it is, of course, possible, in particular in the cases where a mount is provided with more than one movable portion, for a movable portion to be provided also at the end of a mount.

With the above and other objects in view there is provided, in accordance with the invention, a carrying-cable shoe for a carrying cable of a cableway system which includes a monitoring and detection system as described above.

Other features which are considered as characteristic for the invention are set forth in the appended claims.

Although the invention is illustrated and described herein as embodied in a system and device on a cableway (person or goods-conveying system) for detecting the incorrect positioning of a carrying cable on a mount with a channel in which the carrying cable is located, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 2:
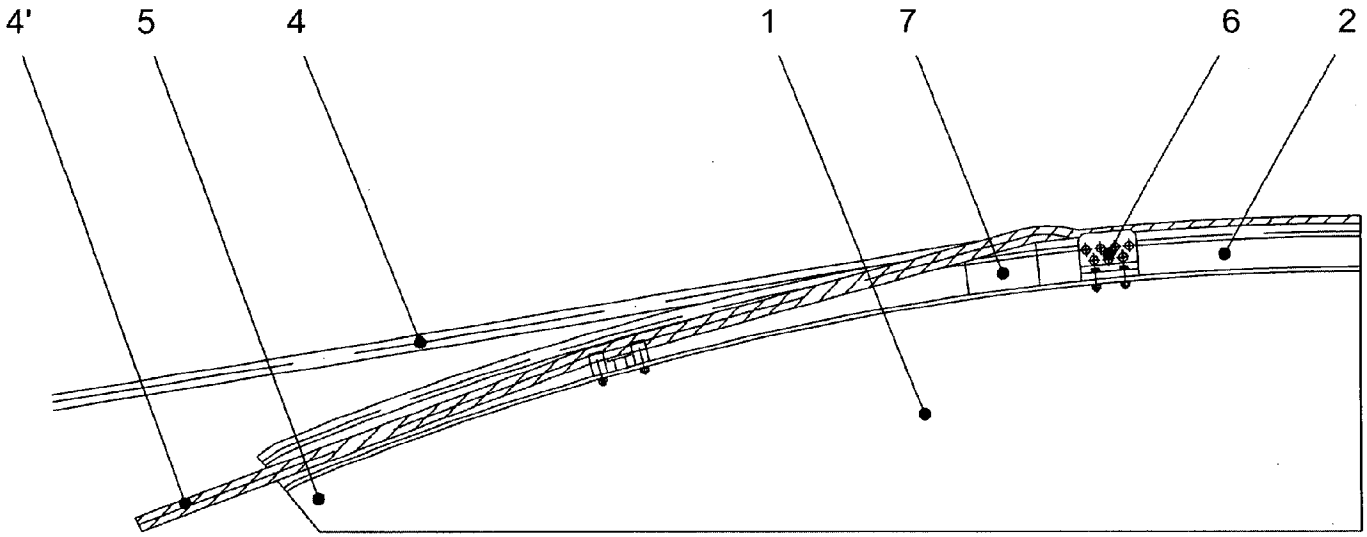
FIG. 2 is a perspective side view of the same part of the saddle.
Figure 1:
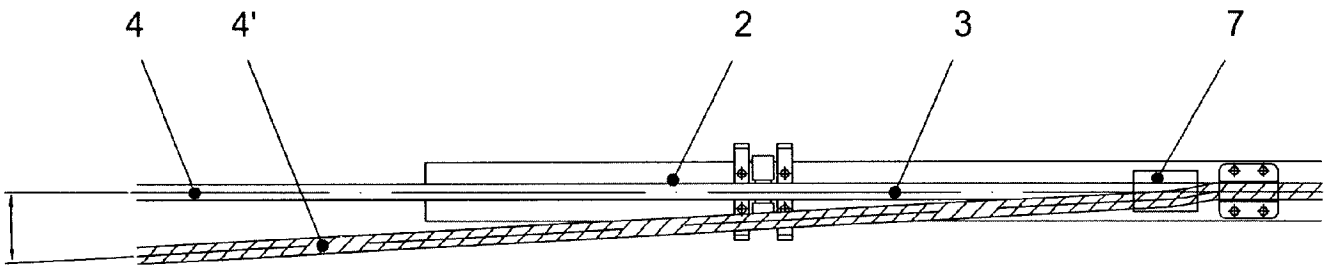
FIG. 1 shows a plan view of part of a saddle for a carrying cable of a cableway with a partially derailed carrying cable.

Referring now to the figures of the drawing in detail and first, particularly, to FIG. 1 thereof, there is illustrated a plan view of part of a saddle. There is seen a mount 2 which has a channel 3 which, in the installed position, is upwardly open and in which a carrying cable 4 is located. As FIG. 2 shows, the carrying cable 4, in the non-loaded state, rather than reaching the end 5 of the mount 2 in the channel 3, is located only in the central region. The reference symbol 4' is used in FIGS. 1 and 2 to illustrate the carrying cable 4 in a so-called incorrect or faulty position, in which the carrying cable 4' is partially derailed, that is to say it is no longer located correctly in and/or over the channel 3.

Clamps 6 and carrying-cable interceptors are fitted on the mount 2, although these, of course, need not always be present. The clamps 6 in the central region prevent further derailment of the carrying cable 4 from the mount. The carrying-cable interceptors serve for intercepting the carrying cable 4 when adverse conditions result in the carrying cable 4' being derailed between the end 5 of the mount 2 and the clamp 6.

A movable segment 7 of the mount 2, i.e., a movably mounted portion 7, is arranged between the clamp 6 and the end 5 of the mount 2. The movable segment 7, which is illustrated on its own in FIGS. 3 and 4 and, in the event of the carrying cable 4 being positioned correctly, assumes the position which is illustrated in FIG. 3 and, in the event of the carrying cable 4' being positioned incorrectly, assumes the position which is illustrated in FIG. 4.

Figure 3:
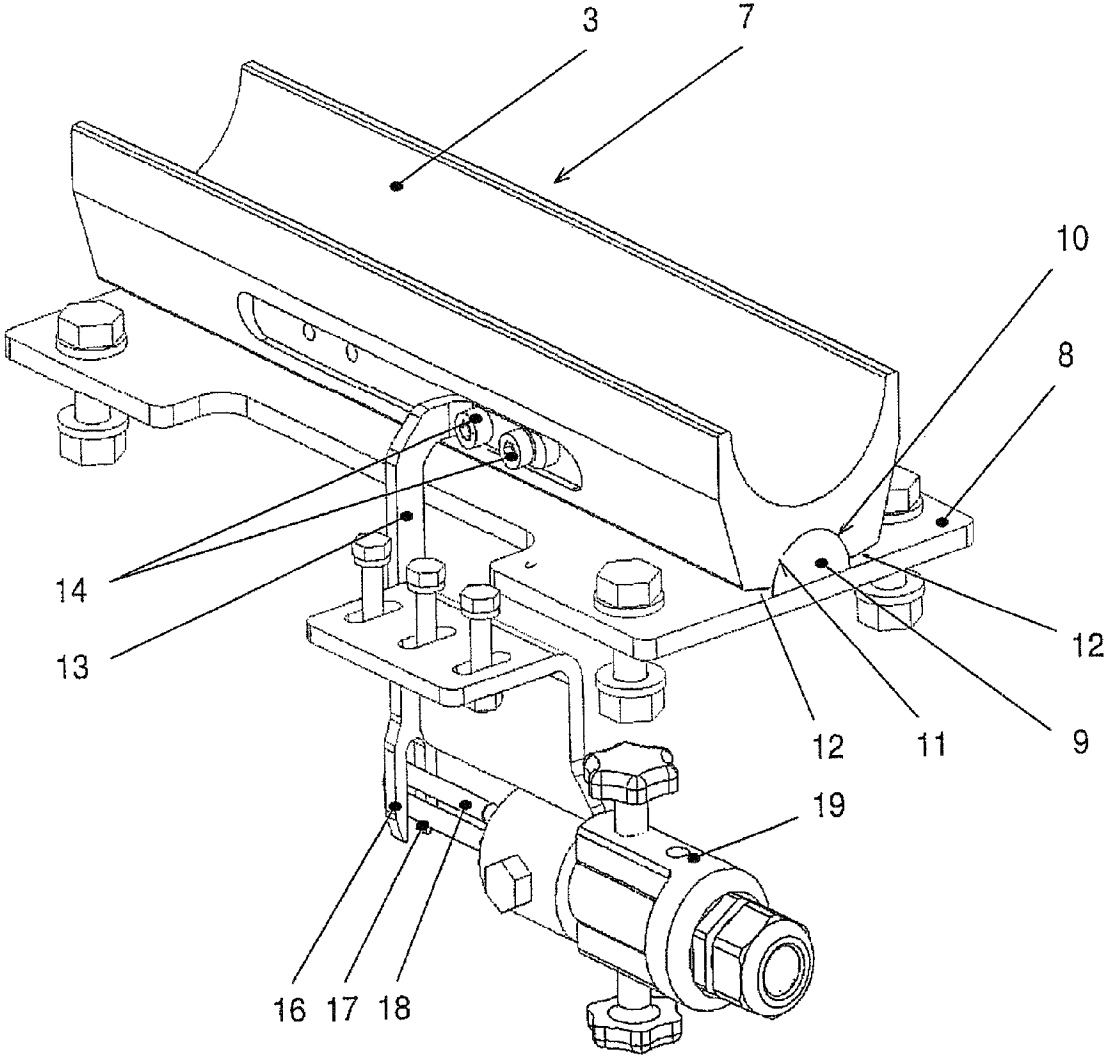
FIG. 3 is a perspective view solely of a movable portion of the mount for the carrying cable in the non-release state.
Figure 4:
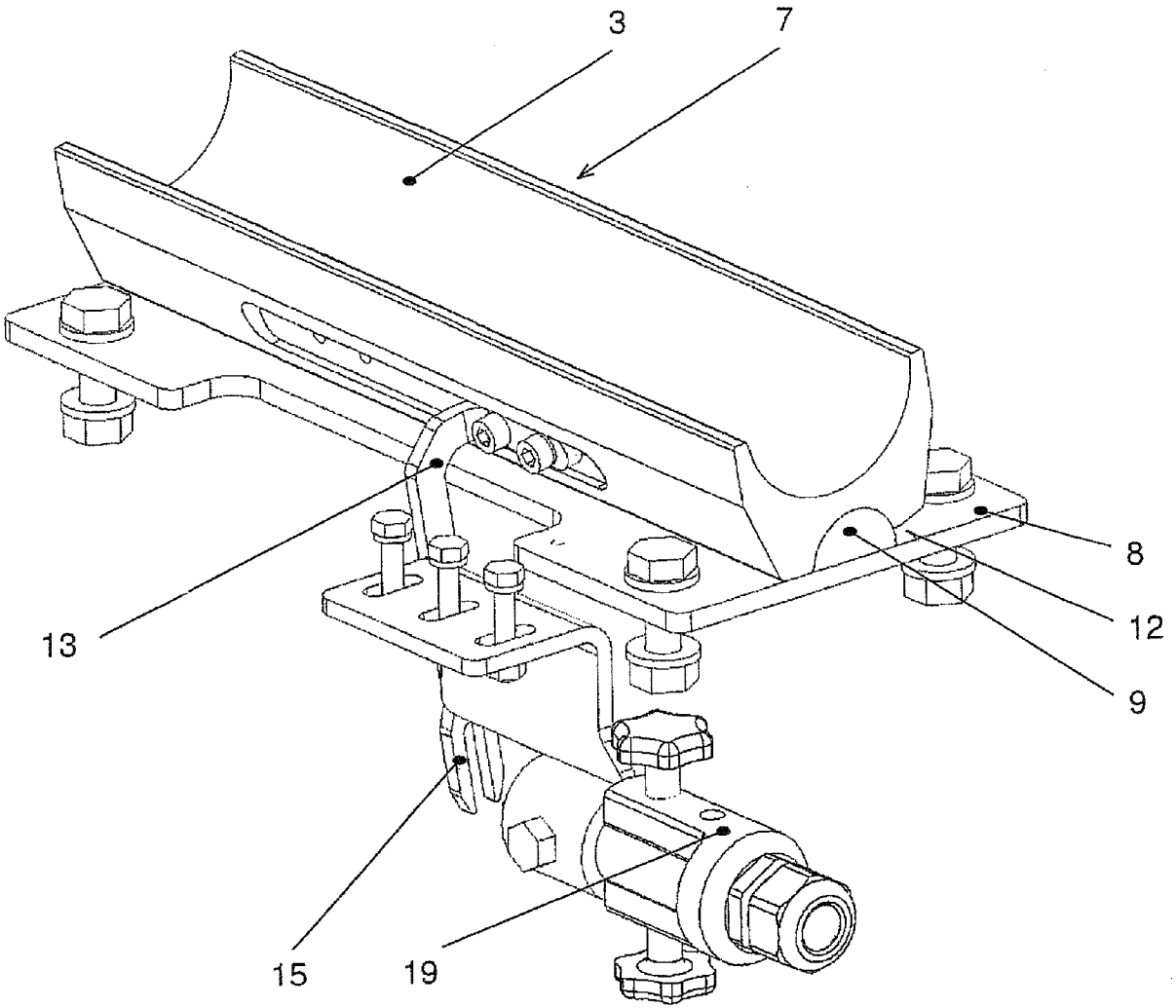
FIG. 4 is a similar view of the portion shown in FIG. 3, in the release state.

The segment 7 of the mount 2 which is illustrated in FIGS. 3 and 4 has essentially the same cross-sectional shape as the rest of the portions of the mount 2, but, rather than being fixed to an installation plate, is fastened in a movable manner on an articulation plate 8. The movement capability of the movable segment 7 is provided for, in the exemplary embodiment illustrated, with the aid of a rib 9 which is arranged on the articulation plate and has a sliding surface 10 directed toward the movable segment 7. The sliding surface 10 has the geometrical shape of a circular-cylinder portion, as does the mating surface 11 on the movable segment 7. Since the movable segment 7 is spaced apart from the articulation plate 8, on both sides of the rib 9, by a gap 12, the movable segment 7 can be displaced laterally along the sliding surface 10, 11 until it butts against the articulation plate 8. The point of rotation, or the axis of rotation of the movement of the movable segment 7 is located at the geometrical center point of the sliding surfaces 10, 11.

Instead of the segment 7 sliding on a rib 9 on the articulation plate 8, it would also be possible, for example, for the segment 7 itself to be divided longitudinally and for a top part of the segment 7 to slide on a bottom part. However, it would also be possible to use an entirely conventional articulation between the segment 7 and the articulation plate 8 having an articulation pin and two or more bearing bushings, of which the axis of articulation runs essentially parallel to the axis of the carrying cable.

If the carrying cable 4 begins to slide out of the channel 3 as a result of external forces, as illustrated in FIGS. 1 and 2, the movable segment 7 is tilted all the more to the side the further the carrying cable 4 slides out of the channel 3 in the region of the movable segment 7. A lever 13 is fastened on the movable segment 7, in the exemplary embodiment illustrated it is screwed thereon with the aid of two screws 14, and has a bifurcation in the region of its free end 15. Accommodated between the two fingers 16, 17 is an interrupting rod 18 which is bent in the form of a U and is fitted on a device for detecting incorrect positioning of the carrying cable 4 in the form of a so-called interrupting-rod switch 19. The interrupting rod 18 has current flowing through it, the current being interrupted when the interrupting rod 18 breaks.

If the movable segment 7 is moved toward one side or the other by incorrect positioning of the carrying cable 4, the lever 13 fastened thereon is also moved to the side. There is a small spacing between the fingers 16, 17 and the interrupting rod 18, the size of this spacing making it possible to define the admissible position deviation of the movable segment 7. If this admissible position deviation is exceeded, the interrupting rod 18 is bent to the side by one of the two fingers 16 or 17 until, once a certain level of elastic deformability has been exceeded, it breaks. This interrupts the flow of current and the interrupting-rod switch 19 detects a safety-specific change in position of the movable segment 7 and transmits a corresponding signal to the central control means of the cableway system which, in accordance with the safety regulations, either reduces the traveling speed of the transporting means or brings the same to a standstill.

Since, in contrast to the prior art, the assembly according to the invention can be used to detect incorrect positioning of the carrying cable 4 without a transporting means having to come into close proximity with the cable shoe, it is possible to prevent complete derailment and to avoid damage which may possibly occur, in certain conditions, as a result.

The invention claimed is:

1. In a cableway or goods-conveying system with a carrying cable, an assembly for detecting a faulty positioning of the carrying cable, comprising:

a mount formed with a channel in which the carrying cable is located;

said mount having a movably mounted segment forming a portion of said mount;

said movably mounted segment of said mount being pivotally mounted about an axis of rotation oriented in a longitudinal direction of the carrying cable and, in an installed position thereof, disposed beneath said channel; and a device disposed to detect a movement of said movably mounted segment of said mount for detecting a faulty positioning of the carrying cable.

2. The assembly according to claim 1, wherein said device is mechanically coupled to said movably mounted segment of said mount.

3. The assembly according to claim 2, wherein said device includes an interrupting rod configured to be broken off by said movably mounted segment of said mount when a change in a position of said movably mounted segment exceeds a predetermined value.

4. The assembly according to claim 2, wherein said device includes an interrupting rod and a lever connected to said movable mounted segment of said mount, and wherein said interrupting rod is broken off by said lever when a change in a position of said movably mounted segment exceeds a predetermined value.

5. The assembly according to claim 1, wherein said movably mounted segment of said mount is displaceably mounted along a sliding surface.

6. The assembly according to claim 5, wherein the sliding surface is curved.

7. The assembly according to claim 6, wherein the sliding surface is formed by a circular-cylindrical portion.

8. The assembly according to claim 6, wherein an axis of curvature of the sliding surface, in an installed position thereof, is located vertically beneath the axis of curvature of said channel.

9. The assembly according to claim 1, wherein said movably mounted segment of said mount is spaced apart from one end of said mount.

10. The assembly according to claim 1, wherein said movably mounted segment of said mount is located between one end of said mount and a clamp for the carrying cable.

11. A shoe for a carrying cable of a cableway system, comprising the assembly according to claim 1 mounted on the carrying-cable shoe.

12. In a cableway or goods-conveying system with a carrying cable supported to travel along a given travel direction, an assembly for detecting a faulty positioning of the carrying cable in a lateral direction, the assembly comprising:

a mount formed with a channel in which the carrying cable is located;

said mount having a movably mounted segment forming a portion of said mount and having said channel in which the carrying cable is located;

said movably mounted segment of said mount being displaceably mounted along a curved sliding surface, such that said channel of said movably mounted segment is displaceable in a lateral direction transversely to the given travel direction; and a device disposed to detect a lateral movement of said movably mounted segment of said mount for detecting a faulty positioning of the carrying cable.

13. The assembly according to claim 12, wherein the sliding surface is formed by a circular-cylindrical portion.

14. The assembly according to claim 12, wherein an axis of curvature of the sliding surface, in an installed position thereof, is located vertically beneath the axis of curvature of said channel.

* * * * *